US012025418B2

(12) United States Patent
Gish et al.

(10) Patent No.: US 12,025,418 B2
(45) Date of Patent: Jul. 2, 2024

(54) CARTRIDGE WITH INNER SURFACE GROOVES FOR A CONDUCTED ELECTRICAL WEAPON

(71) Applicant: Axon Enterprise, Inc., Scottsdale, AZ (US)

(72) Inventors: Michael E. Gish, Scottsdale, AZ (US); David Fulton, Scottsdale, AZ (US); William E. Maginn, San Diego, CA (US); John Groff, San Francisco, CA (US); Samuel R. Driscoll, Phoenix, AZ (US)

(73) Assignee: Axon Enterprise, Inc., Scottsdale, AZ (US)

( * ) Notice: Subject to any disclaimer, the term of this patent is extended or adjusted under 35 U.S.C. 154(b) by 0 days.

(21) Appl. No.: 17/873,033

(22) Filed: Jul. 25, 2022

(65) Prior Publication Data

US 2023/0036491 A1 Feb. 2, 2023

Related U.S. Application Data

(60) Provisional application No. 63/226,104, filed on Jul. 27, 2021.

(51) Int. Cl.

| | |
|---|---|
| ***F42B 5/02*** | (2006.01) |
| ***F41A 21/18*** | (2006.01) |
| ***F41F 1/08*** | (2006.01) |
| ***F41H 13/00*** | (2006.01) |

(52) U.S. Cl.

CPC ..... *F42B 5/02* (2013.01); *F41A 21/18* (2013.01); *F41F 1/08* (2013.01); *F41H 13/0025* (2013.01)

(58) Field of Classification Search

CPC .. F41H 13/00; F41H 13/0012; F41H 13/0025; F41H 13/0031; F42B 5/02; F42B 5/03; F42B 5/035; F41A 21/18; F41F 1/08

USPC ..... 102/430, 502, 504

See application file for complete search history.

(56) References Cited

U.S. PATENT DOCUMENTS

| | | | | | |
|---|---|---|---|---|---|
| 1,741,901 | A | * | 12/1929 | Alden | F42B 5/02 102/502 |
| RE18,252 | E | * | 11/1931 | Alden | F42B 5/02 102/439 |
| 2,926,566 | A | | 3/1960 | Atkins et al. | |
| 5,831,199 | A | | 11/1998 | McNulty, Jr. et al. | |

(Continued)

FOREIGN PATENT DOCUMENTS

| | | | |
|---|---|---|---|
| CN | 102159914 | B | 10/2013 |
| CN | 207351302 | U | 5/2018 |

(Continued)

OTHER PUBLICATIONS

Taiwan IPO, Office Action for Taiwanese Application No. 111127946 mailed Jul. 6, 2023.

(Continued)

*Primary Examiner* — James S Bergin
(74) *Attorney, Agent, or Firm* — Justin Powley

(57) ABSTRACT

A cartridge for a conducted electrical weapon may comprise a body having a first end opposite a second end and an outer surface opposite an inner surface. A projectile may be disposed within the body. The inner surface of the body may define a plurality of grooves extending from the first end of the body to a location within the body.

20 Claims, 5 Drawing Sheets

(56) References Cited

U.S. PATENT DOCUMENTS

| | | | | |
|---|---|---|---|---|
| 6,647,890 | B2 * | 11/2003 | Findlay | F41C 3/02 102/521 |
| 6,877,434 | B1 | 4/2005 | McNulty, Jr. | |
| 7,089,863 | B1 * | 8/2006 | Dindl | F42B 8/14 102/524 |
| 7,950,176 | B1 | 5/2011 | Nemtyshkin et al. | |
| 7,950,329 | B1 | 5/2011 | Nemtyshkin et al. | |
| 8,342,098 | B2 | 1/2013 | Shalev et al. | |
| 10,066,905 | B2 | 9/2018 | Heroor et al. | |
| 10,161,722 | B1 | 12/2018 | Salisbury et al. | |
| 10,168,127 | B1 | 1/2019 | Salisbury et al. | |
| 10,598,467 | B1 | 3/2020 | McDermit et al. | |
| 10,731,953 | B2 | 8/2020 | Petrovic et al. | |
| 11,041,698 | B2 | 6/2021 | Nemtyshkin et al. | |
| 2006/0207466 | A1 | 9/2006 | McNulty et al. | |
| 2009/0293853 | A1 | 12/2009 | Belokin | |
| 2010/0050856 | A1 | 3/2010 | Baldwin | |
| 2010/0275806 | A1 | 11/2010 | Gavin et al. | |
| 2012/0152145 | A1 | 6/2012 | Kuchman | |
| 2014/0233146 | A1 | 8/2014 | Gavin | |
| 2015/0002981 | A1 | 1/2015 | Klug et al. | |
| 2017/0059661 | A1 | 3/2017 | Foldyna | |
| 2018/0283829 | A1 | 10/2018 | Petrovic et al. | |
| 2019/0128650 | A1 | 5/2019 | Kim | |
| 2020/0109933 | A1 | 4/2020 | Brundula et al. | |
| 2020/0284556 | A1 | 9/2020 | Nemtyshkin et al. | |
| 2022/0082357 | A1 | 3/2022 | Smith et al. | |
| 2022/0228841 | A1 | 7/2022 | Smith et al. | |

FOREIGN PATENT DOCUMENTS

| | | | |
|---|---|---|---|
| CN | 108444337 | A | 8/2018 |
| KR | 10-2008-0000589 | A | 1/2008 |
| KR | 101890759 | B1 | 3/2018 |
| KR | 101872709 | B1 | 7/2018 |
| RU | 2275576 | C1 | 4/2006 |
| RU | 68671 | U1 | 11/2007 |
| RU | 2351871 | C1 | 4/2009 |
| RU | 2477441 | C1 | 3/2013 |
| RU | 2480704 | C2 | 4/2013 |
| RU | 2526159 | C2 | 8/2014 |
| RU | 2527242 | C2 | 8/2014 |
| RU | 2648562 | C1 | 3/2018 |
| TW | M400579 | U | 3/2011 |
| TW | M564151 | U | 7/2018 |
| WO | 2009025575 | A1 | 2/2009 |
| WO | 820090025575 | A1 | 2/2009 |
| WO | 2021101604 | A1 | 5/2021 |

OTHER PUBLICATIONS

Korean Intellectual Property Office, International Search Report for International Application No. PCT/US2022/038225 mailed Apr. 14, 2023.

Taiwan Patent Office, Allowance Decision of Examination for Taiwan Application No. 111127946 mailed Apr. 23, 2024.

* cited by examiner

CARTRIDGE WITH INNER SURFACE GROOVES FOR A CONDUCTED ELECTRICAL WEAPON

FIELD OF THE INVENTION

Embodiments of the present disclosure relate to a conducted electrical weapon ("CEW").

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the following illustrative figures. In the following figures, like reference numbers refer to similar elements and steps throughout the figures.

Figure 1:
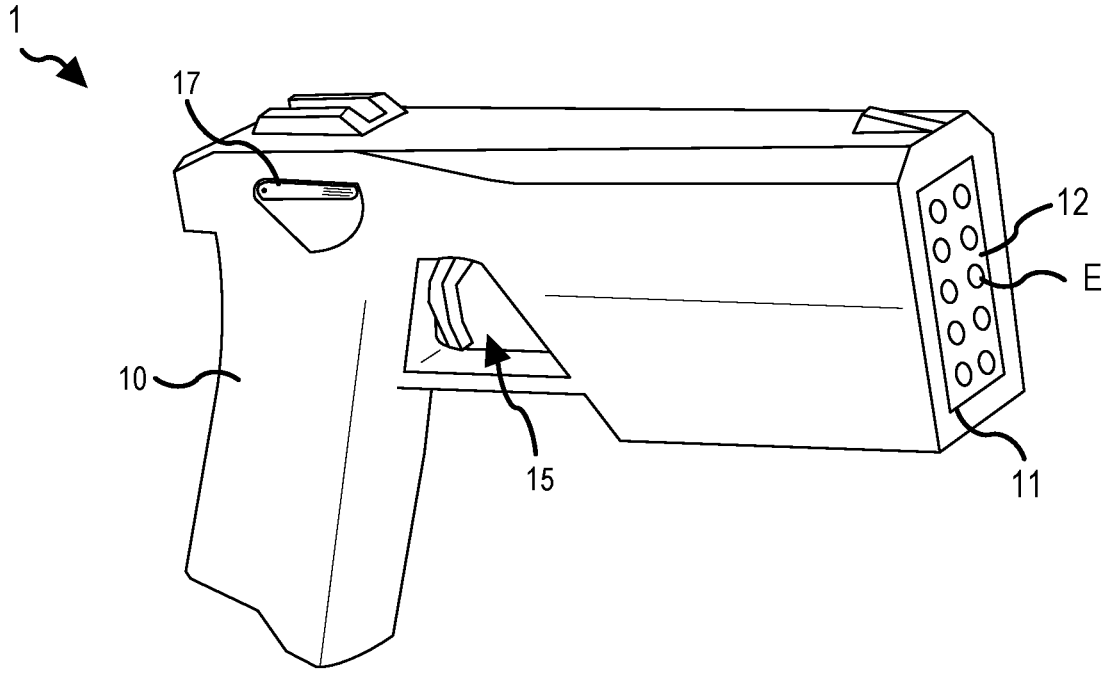
FIG. 1 is a perspective view of a conducted electrical weapon ("CEW"), in accordance with various embodiments.

Elements and steps in the figures are illustrated for simplicity and clarity and have not necessarily been rendered according to any particular sequence. For example, steps that may be performed concurrently or in different order are illustrated in the figures to help to improve understanding of embodiments of the present disclosure.

DETAILED DESCRIPTION

The detailed description of exemplary embodiments herein makes reference to the accompanying drawings, which show exemplary embodiments by way of illustration. While these embodiments are described in sufficient detail to enable those skilled in the art to practice the disclosures, it should be understood that other embodiments may be realized and that logical changes and adaptations in design and construction may be made in accordance with this disclosure and the teachings herein. Thus, the detailed description herein is presented for purposes of illustration only and not of limitation.

The scope of the disclosure is defined by the appended claims and their legal equivalents rather than by merely the examples described. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, coupled, connected, or the like may include permanent, removable, temporary, partial, full, and/or any other possible attachment option. Surface shading lines may be used throughout the figures to denote different parts but not necessarily to denote the same or different materials.

Systems, methods, and apparatuses may be used to interfere with voluntary locomotion (e.g., walking, running, moving, etc.) of a target. For example, a CEW may be used to deliver a current (e.g., stimulus signal, pulses of current, pulses of charge, etc.) through tissue of a human or animal target. Although typically referred to as a conducted electrical weapon, as described herein a "CEW" may refer to a conducted electrical weapon, a conducted energy weapon, an electronic control device, and/or any other similar device or apparatus configured to provide a stimulus signal through one or more deployed projectiles (e.g., electrodes).

A stimulus signal carries a charge into target tissue. The stimulus signal may interfere with voluntary locomotion of the target. The stimulus signal may cause pain. The pain may also function to encourage the target to stop moving. The stimulus signal may cause skeletal muscles of the target to become stiff (e.g., lock up, freeze, etc.). The stiffening of the muscles in response to a stimulus signal may be referred to as neuromuscular incapacitation ("NMI"). NMI disrupts voluntary control of the muscles of the target. The inability of the target to control its muscles interferes with locomotion of the target.

A stimulus signal may be delivered through the target via terminals coupled to the CEW. Delivery via terminals may be referred to as a local delivery (e.g., a local stun, a drive stun, etc.). During local delivery, the terminals are brought close to the target by positioning the CEW proximate to the target. The stimulus signal is delivered through the target's tissue via the terminals. To provide local delivery, the user of the CEW is generally within arm's reach of the target and brings the terminals of the CEW into contact with or proximate to the target.

A stimulus signal may be delivered through the target via one or more (typically at least two) wire-tethered electrodes. Delivery via wire-tethered electrodes may be referred to as a remote delivery (e.g., a remote stun). During a remote delivery, the CEW may be separated from the target up to the length (e.g., 15 feet, 20 feet, 30 feet, etc.) of the wire tether. The CEW launches the electrodes towards the target. As the electrodes travel toward the target, the respective wire tethers deploy behind the electrodes. The wire tether electrically couples the CEW to the electrode. The electrode may electrically couple to the target thereby coupling the CEW to the target. In response to the electrodes connecting with, impacting on, or being positioned proximate to the target's tissue, the current may be provided through the target via the electrodes (e.g., a circuit is formed through the first tether and the first electrode, the target's tissue, and the second electrode and the second tether).

Terminals or electrodes that contact or are proximate to the target's tissue deliver the stimulus signal through the target. Contact of a terminal or electrode with the target's tissue establishes an electrical coupling (e.g., circuit) with the target's tissue. Electrodes may include a spear that may pierce the target's tissue to contact the target. A terminal or electrode that is proximate to the target's tissue may use ionization to establish an electrical coupling with the target's tissue. Ionization may also be referred to as arcing.

In use (e.g., during deployment), a terminal or electrode may be separated from the target's tissue by the target's clothing or a gap of air. In various embodiments, a signal generator of the CEW may provide the stimulus signal (e.g., current, pulses of current, etc.) at a high voltage (e.g., in the range of 40,000 to 100,000 volts) to ionize the air in the clothing or the air in the gap that separates the terminal or electrode from the target's tissue. Ionizing the air establishes a low impedance ionization path from the terminal or electrode to the target's tissue that may be used to deliver the stimulus signal into the target's tissue via the ionization path. The ionization path persists (e.g., remains in existence, lasts, etc.) as long as the current of a pulse of the stimulus signal is provided via the ionization path. When the current ceases or is reduced below a threshold (e.g., amperage, voltage), the ionization path collapses (e.g., ceases to exist) and the terminal or electrode is no longer electrically coupled to the target's tissue. Lacking the ionization path, the impedance between the terminal or electrode and target tissue is high. A high voltage in the range of about 50,000 volts can ionize air in a gap of up to about one inch.

A CEW may provide a stimulus signal as a series of current pulses. Each current pulse may include a high voltage portion (e.g., 40,000-100,000 volts) and a low voltage portion (e.g., 500-6,000 volts). The high voltage portion of a pulse of a stimulus signal may ionize air in a gap between an electrode or terminal and a target to electrically couple the electrode or terminal to the target. In response to the electrode or terminal being electrically coupled to the target, the low voltage portion of the pulse delivers an amount of charge into the target's tissue via the ionization path. In response to the electrode or terminal being electrically coupled to the target by contact (e.g., touching, spear embedded into tissue, etc.), the high portion of the pulse and the low portion of the pulse both deliver charge to the target's tissue. Generally, the low voltage portion of the pulse delivers a majority of the charge of the pulse into the target's tissue. In various embodiments, the high voltage portion of a pulse of the stimulus signal may be referred to as the spark or ionization portion. The low voltage portion of a pulse may be referred to as the muscle portion.

In various embodiments, a signal generator of the CEW may provide the stimulus signal (e.g., current, pulses of current, etc.) at only a low voltage (e.g., less than 2,000 volts). The low voltage stimulus signal may not ionize the air in the clothing or the air in the gap that separates the terminal or electrode from the target's tissue. A CEW having a signal generator providing stimulus signals at only a low voltage (e.g., a low voltage signal generator) may require deployed electrodes to be electrically coupled to the target by contact (e.g., touching, spear embedded into tissue, etc.).

A CEW may include at least two terminals at the face of the CEW. A CEW may include two terminals for each bay that accepts a magazine. The terminals are spaced apart from each other. In response to the electrodes of the magazine in the bay having not been deployed, the high voltage impressed across the terminals will result in ionization of the air between the terminals. The arc between the terminals may be visible to the naked eye. In response to a launched electrode not electrically coupling to a target, the current that would have been provided via the electrodes may arc across the face of the CEW via the terminals.

The likelihood that the stimulus signal will cause NMI increases when the electrodes that deliver the stimulus signal are spaced apart at least 6 inches (15.24 centimeters) so that the current from the stimulus signal flows through the at least 6 inches of the target's tissue. In various embodiments, the electrodes preferably should be spaced apart at least 12 inches (30.48 centimeters) on the target. Because the terminals on a CEW are typically less than 6 inches apart, a stimulus signal delivered through the target's tissue via terminals likely will not cause NMI, only pain.

A series of pulses may include two or more pulses separated in time. Each pulse delivers an amount of charge into the target's tissue. In response to the electrodes being appropriately spaced (as discussed above), the likelihood of inducing NMI increases as each pulse delivers an amount of charge in the range of 55 microcoulombs to 71 microcoulombs per pulse. The likelihood of inducing NMI increases when the rate of pulse delivery (e.g., rate, pulse rate, repetition rate, etc.) is between 11 pulses per second ("pps") and 50 pps. Pulses delivered at a higher rate may provide less charge per pulse to induce NMI. Pulses that deliver more charge per pulse may be delivered at a lesser rate to induce NMI. In various embodiments, a CEW may be hand-held and use batteries to provide the pulses of the stimulus signal. In response to the amount of charge per pulse being high and the pulse rate being high, the CEW may use more energy than is needed to induce NMI. Using more energy than is needed depletes batteries more quickly.

Empirical testing has shown that the power of the battery may be conserved with a high likelihood of causing NMI in response to the pulse rate being less than 44 pps and the charge per a pulse being about 63 microcoulombs. Empirical testing has shown that a pulse rate of 22 pps and 63 microcoulombs per a pulse via a pair of electrodes will induce NMI when the electrode spacing is at least 12 inches (30.48 centimeters).

In various embodiments, a CEW may include a handle and one or more magazines. The handle may include one or more bays for receiving the magazine(s). Each magazine may be removably positioned in (e.g., inserted into, coupled to, etc.) a bay. Each magazine may releasably electrically, electronically, and/or mechanically couple to a bay. A deployment of the CEW may launch one or more electrodes from the magazine and toward a target to remotely deliver the stimulus signal through the target.

In various embodiments, a magazine may include two or more electrodes (e.g., projectiles, etc.) that are launched at the same time. In various embodiments, a magazine may include two or more electrodes that may each be launched individually at separate times. In various embodiments, a magazine may include a single electrode configured to be launched from the magazine. Launching the electrodes may be referred to as activating (e.g., firing) a magazine or electrode. In some embodiments, after use (e.g., activation, firing), a magazine may be removed from the bay and the used electrodes may be removed from the magazine and replaced with unused (e.g., not fired, not activated) electrodes. The magazine may be inserted into the bay again to permit launch of additional electrodes. In some embodiments, after use (e.g., activation, firing), a magazine may be removed from the bay and replaced with an unused (e.g., not fired, not activated) magazine to permit launch of additional electrodes.

Figure 2:
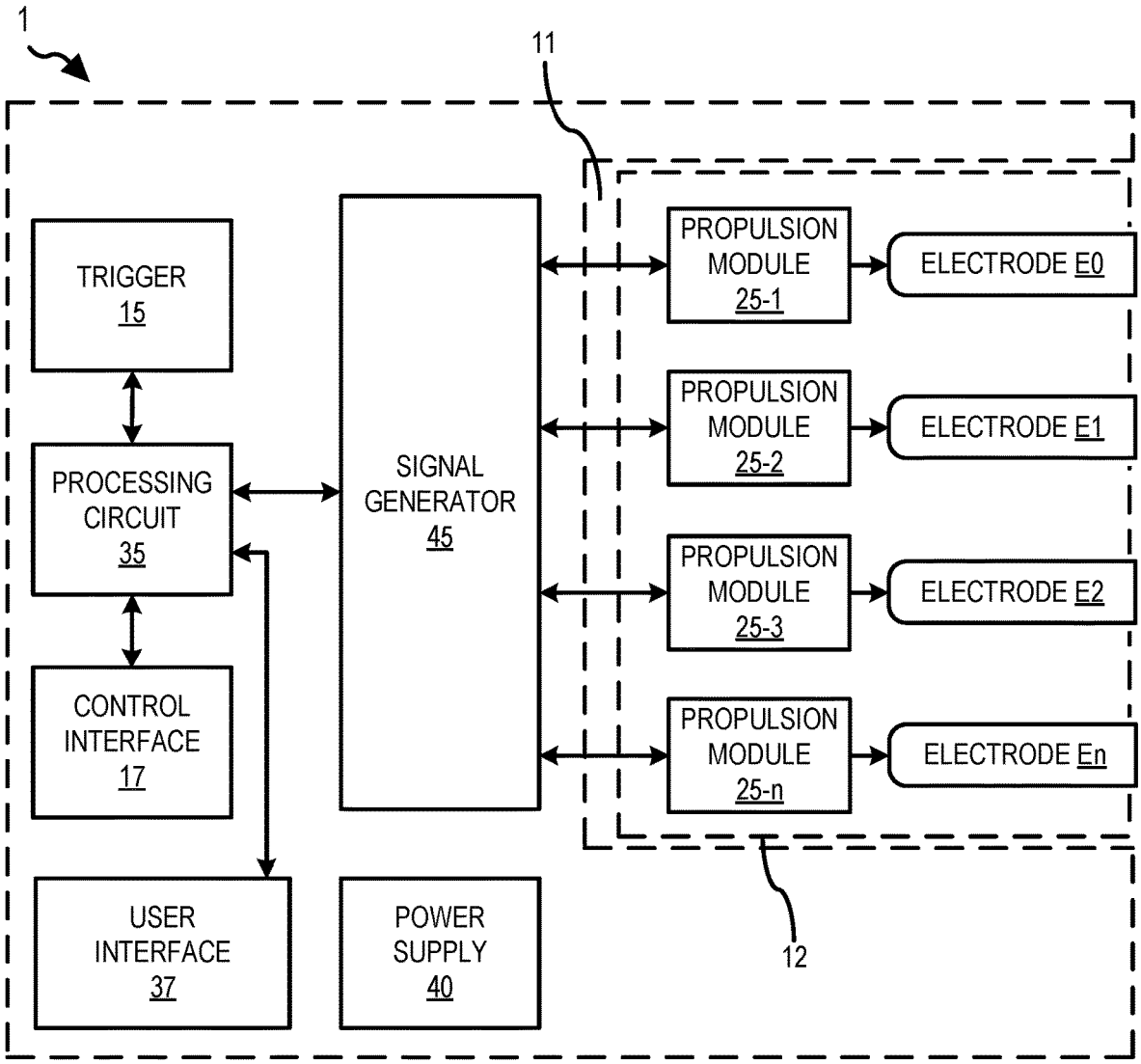
FIG. 2 is a schematic view of a CEW, in accordance with various embodiments.

In various embodiments, and with reference to FIGS. 1 and 2, a CEW 1 is disclosed. CEW 1 may be similar to, or have similar aspects and/or components with, any CEW discussed herein. CEW 1 may comprise a housing 10 and a magazine 12. It should be understood by one skilled in the art that FIG. 2 is a schematic representation of CEW 1, and one or more of the components of CEW 1 may be located in any suitable position within, or external to, housing 10.

Housing 10 may be configured to house various components of CEW 1 that are configured to enable deployment of magazine 12, provide an electrical current to magazine 12, and otherwise aid in the operation of CEW 1, as discussed further herein. Although depicted as a firearm in FIG. 1, housing 10 may comprise any suitable shape and/or size. Housing 10 may comprise a handle end opposite a deployment end. A deployment end may be configured, and sized and shaped, to receive one or more magazine 12. A handle end may be sized and shaped to be held in a hand of a user. For example, a handle end may be shaped as a handle to enable hand-operation of CEW 1 by the user. In various embodiments, a handle end may also comprise contours shaped to fit the hand of a user, for example, an ergonomic grip. A handle end may include a surface coating, such as, for example, a non-slip surface, a grip pad, a rubber texture, and/or the like. As a further example, a handle end may be wrapped in leather, a colored print, and/or any other suitable material, as desired.

In various embodiments, housing 10 may comprise various mechanical, electronic, and/or electrical components configured to aid in performing the functions of CEW 1. For example, housing 10 may comprise one or more triggers 15, control interfaces 17, processing circuits 35, power supplies 40, and/or signal generators 45. Housing 10 may include a guard (e.g., trigger guard). A guard may define an opening formed in housing 10. A guard may be located on a center region of housing 10 (e.g., as depicted in FIG. 1), and/or in any other suitable location on housing 10. Trigger 15 may be disposed within a guard. A guard may be configured to protect trigger 15 from unintentional physical contact (e.g., an unintentional activation of trigger 15). A guard may surround trigger 15 within housing 10.

In various embodiments, trigger 15 be coupled to an outer surface of housing 10, and may be configured to move, slide, rotate, or otherwise become physically depressed or moved upon application of physical contact. For example, trigger 15 may be actuated by physical contact applied to trigger 15 from within a guard. Trigger 15 may comprise a mechanical or electromechanical switch, button, trigger, or the like. For example, trigger 15 may comprise a switch, a pushbutton, and/or any other suitable type of trigger. Trigger 15 may be mechanically and/or electronically coupled to processing circuit 35. In response to trigger 15 being activated (e.g., depressed, pushed, etc. by the user), processing circuit 35 may enable deployment of (or cause deployment of) one or more magazine 12 from CEW 1, as discussed further herein.

In various embodiments, power supply 40 may be configured to provide power to various components of CEW 1. For example, power supply 40 may provide energy for operating the electronic and/or electrical components (e.g., parts, subsystems, circuits, etc.) of CEW 1 and/or one or more magazine 12. Power supply 40 may provide electrical power. Providing electrical power may include providing a current at a voltage. Power supply 40 may be electrically coupled to processing circuit 35 and/or signal generator 45. In various embodiments, in response to a control interface comprising electronic properties and/or components, power supply 40 may be electrically coupled to the control interface. In various embodiments, in response to trigger 15 comprising electronic properties or components, power supply 40 may be electrically coupled to trigger 15. Power supply 40 may provide an electrical current at a voltage. Electrical power from power supply 40 may be provided as a direct current ("DC"). Electrical power from power supply 40 may be provided as an alternating current ("AC"). Power supply 40 may include a battery. The energy of power supply 40 may be renewable or exhaustible, and/or replaceable. For example, power supply 40 may comprise one or more rechargeable or disposable batteries. In various embodiments, the energy from power supply 40 may be converted from one form (e.g., electrical, magnetic, thermal) to another form to perform the functions of a system.

Power supply 40 may provide energy for performing the functions of CEW 1. For example, power supply 40 may provide the electrical current to signal generator 45 that is provided through a target to impede locomotion of the target (e.g., via magazine 12). Power supply 40 may provide the energy for a stimulus signal. Power supply 40 may provide the energy for other signals, including an ignition signal, as discussed further herein.

In various embodiments, processing circuit 35 may comprise any circuitry, electrical components, electronic components, software, and/or the like configured to perform various operations and functions discussed herein. For example, processing circuit 35 may comprise a processing circuit, a processor, a digital signal processor, a microcontroller, a microprocessor, an application specific integrated circuit (ASIC), a programmable logic device, logic circuitry, state machines, MEMS devices, signal conditioning circuitry, communication circuitry, a computer, a computer-based system, a radio, a network appliance, a data bus, an address bus, and/or any combination thereof. In various embodiments, processing circuit 35 may include passive electronic devices (e.g., resistors, capacitors, inductors, etc.) and/or active electronic devices (e.g., op amps, comparators, analog-to-digital converters, digital-to-analog converters, programmable logic, SRCs, transistors, etc.). In various embodiments, processing circuit 35 may include data buses, output ports, input ports, timers, memory, arithmetic units, and/or the like.

In various embodiments, processing circuit 35 may include signal conditioning circuity. Signal conditioning circuitry may include level shifters to change (e.g., increase, decrease) the magnitude of a voltage (e.g., of a signal) before receipt by processing circuit 35 or to shift the magnitude of a voltage provided by processing circuit 35.

In various embodiments, processing circuit 35 may be configured to control and/or coordinate operation of some or all aspects of CEW 1. For example, processing circuit 35 may include (or be in communication with) memory configured to store data, programs, and/or instructions. The memory may comprise a tangible non-transitory computer-readable memory. Instructions stored on the tangible non-transitory memory may allow processing circuit 35 to perform various operations, functions, and/or steps, as described herein.

In various embodiments, the memory may comprise any hardware, software, and/or database component capable of storing and maintaining data. For example, a memory unit may comprise a database, data structure, memory component, or the like. A memory unit may comprise any suitable non-transitory memory known in the art, such as, an internal memory (e.g., random access memory (RAM), read-only memory (ROM), solid state drive (SSD), etc.), removable memory (e.g., an SD card, an xD card, a CompactFlash card, etc.), or the like.

Processing circuit 35 may be configured to provide and/or receive electrical signals whether digital and/or analog in form. Processing circuit 35 may provide and/or receive digital information via a data bus using any protocol. Processing circuit 35 may receive information, manipulate the received information, and provide the manipulated information. Processing circuit 35 may store information and retrieve stored information. Information received, stored, and/or manipulated by processing circuit 35 may be used to perform a function, control a function, and/or to perform an operation or execute a stored program.

Processing circuit 35 may control the operation and/or function of other circuits and/or components of CEW 1. Processing circuit 35 may receive status information regarding the operation of other components, perform calculations with respect to the status information, and provide commands (e.g., instructions) to one or more other components. Processing circuit 35 may command another component to start operation, continue operation, alter operation, suspend operation, cease operation, or the like. Commands and/or status may be communicated between processing circuit 35 and other circuits and/or components via any type of bus (e.g., SPI bus) including any type of data/address bus.

In various embodiments, processing circuit 35 may be mechanically and/or electronically coupled to trigger 15. Processing circuit 35 may be configured to detect an activation, actuation, depression, input, etc. (collectively, an "activation event") of trigger 15. In response to detecting the activation event, processing circuit 35 may be configured to perform various operations and/or functions, as discussed further herein. Processing circuit 35 may also include a sensor (e.g., a trigger sensor) attached to trigger 15 and configured to detect an activation event of trigger 15. The sensor may comprise any suitable sensor, such as a mechanical and/or electronic sensor capable of detecting an activation event in trigger 15 and reporting the activation event to processing circuit 35.

In various embodiments, processing circuit 35 may be mechanically and/or electronically coupled to control interface 17. Processing circuit 35 may be configured to detect an activation, actuation, depression, input, etc. (collectively, a "control event") of control interface 17. In response to detecting the control event, processing circuit 35 may be configured to perform various operations and/or functions, as discussed further herein. Processing circuit 35 may also include a sensor (e.g., a control sensor) attached to control interface 17 and configured to detect a control event of control interface 17. The sensor may comprise any suitable mechanical and/or electronic sensor capable of detecting a control event in control interface 17 and reporting the control event to processing circuit 35.

In various embodiments, processing circuit 35 may be electrically and/or electronically coupled to power supply 40. Processing circuit 35 may receive power from power supply 40. The power received from power supply 40 may be used by processing circuit 35 to receive signals, process signals, and transmit signals to various other components in CEW 1. Processing circuit 35 may use power from power supply 40 to detect an activation event of trigger 15, a control event of control interface 17, or the like, and generate one or more control signals in response to the detected events. The control signal may be based on the control event and the activation event. The control signal may be an electrical signal.

In various embodiments, processing circuit 35 may be electrically and/or electronically coupled to signal generator 45. Processing circuit 35 may be configured to transmit or provide control signals to signal generator 45 in response to detecting an activation event of trigger 15. Multiple control signals may be provided from processing circuit 35 to signal generator 45 in series. In response to receiving the control signal, signal generator 45 may be configured to perform various functions and/or operations, as discussed further herein.

In various embodiments, signal generator 45 may be configured to receive one or more control signals from processing circuit 35. Signal generator 45 may provide an ignition signal to magazine 12 based on the control signals. Signal generator 45 may be electrically and/or electronically coupled to processing circuit 35 and/or magazine 12. Signal generator 45 may be electrically coupled to power supply 40. Signal generator 45 may use power received from power supply 40 to generate an ignition signal. For example, signal generator 45 may receive an electrical signal from power supply 40 that has first current and voltage values. Signal generator 45 may transform the electrical signal into an ignition signal having second current and voltage values. The transformed second current and/or the transformed second voltage values may be different from the first current and/or voltage values. The transformed second current and/or the transformed second voltage values may be the same as the first current and/or voltage values. Signal generator 45 may temporarily store power from power supply 40 and rely on the stored power entirely or in part to provide the ignition signal. Signal generator 45 may also rely on received power from power supply 40 entirely or in part to provide the ignition signal, without needing to temporarily store power.

Signal generator 45 may be controlled entirely or in part by processing circuit 35. In various embodiments, signal generator 45 and processing circuit 35 may be separate components (e.g., physically distinct and/or logically discrete). Signal generator 45 and processing circuit 35 may be a single component. For example, a control circuit within housing 10 may at least include signal generator 45 and processing circuit 35. The control circuit may also include other components and/or arrangements, including those that further integrate corresponding function of these elements into a single component or circuit, as well as those that further separate certain functions into separate components or circuits.

Signal generator 45 may be controlled by the control signals to generate an ignition signal having a predetermined current value or values. For example, signal generator 45 may include a current source. The control signal may be received by signal generator 45 to activate the current source at a current value of the current source. An additional control signal may be received to decrease a current of the current source. For example, signal generator 45 may include a pulse width modification circuit coupled between a current source and an output of the control circuit. A second control signal may be received by signal generator 45 to activate the pulse width modification circuit, thereby decreasing a non-zero period of a signal generated by the current source and an overall current of an ignition signal subsequently output by the control circuit. The pulse width modification circuit may be separate from a circuit of the current source or, alternatively, integrated within a circuit of the current source. Various other forms of signal generators 45 may alternatively or additionally be employed, including those that apply a voltage over one or more different resistances to generate signals with different currents. In various embodiments, signal generator 45 may include a high-voltage module configured to deliver an electrical current having a high voltage. In various embodiments, signal generator 45 may include a low-voltage module configured to deliver an electrical current having a lower voltage, such as, for example, 2,000 volts.

Responsive to receipt of a signal indicating activation of trigger 15 (e.g., an activation event), a control circuit provides an ignition signal to magazine 12 (or an electrode in magazine 12). For example, signal generator 45 may provide an electrical signal as an ignition signal to magazine 12 in response to receiving a control signal from processing circuit 35. In various embodiments, the ignition signal may be separate and distinct from a stimulus signal. For example, a stimulus signal in CEW 1 may be provided to a different circuit within magazine 12, relative to a circuit to which an ignition signal is provided. Signal generator 45 may be configured to generate a stimulus signal. In various embodiments, a second, separate signal generator, component, or circuit (not shown) within housing 10 may be configured to generate the stimulus signal. Signal generator 45 may also provide a ground signal path for magazine 12, thereby completing a circuit for an electrical signal provided to magazine 12 by signal generator 45. The ground signal path may also be provided to magazine 12 by other elements in housing 10, including power supply 40.

In various embodiments, a bay 11 of housing 10 may be configured (to receive one or more magazine 12. Bay 11 may comprise an opening in an end of housing 10 sized and shaped to receive one or more magazine 12. Bay 11 may include one or more mechanical features configured to removably couple one or more magazine 12 within bay 11. Bay 11 of housing 10 may be configured to receive a single magazine, two magazines, three magazines, nine magazines, or any other number of magazines.

Magazine 12 may comprise one or more propulsion modules 25 and one or more electrodes E. For example, a magazine 12 may comprise a single propulsion module 25 configured to deploy a single electrode E. As a further example, a magazine 12 may comprise a single propulsion module 25 configured to deploy a plurality of electrodes E. As a further example, a magazine 12 may comprise a plurality of propulsion modules 25 and a plurality of electrodes E, with each propulsion module 25 configured to deploy one or more electrodes E. In various embodiments, and as depicted in FIG. 2, magazine 12 may comprise a first propulsion module 25-1 configured to deploy a first electrode E0, a second propulsion module 25-2 configured to deploy a second electrode E1, a third propulsion module 25-3 configured to deploy a third electrode E2, and a fourth propulsion module 25-4 configured to deploy a fourth electrode En. Each series of propulsion modules and electrodes may be contained in the same and/or separate magazines. As referred to herein, electrodes E0, E1, E2, En may be generally referred to individually as an "electrode E" or collectively as "electrodes E." As referred to herein, propulsion modules 25-1, 25-2, 25-3, **25-*n* may be referred to individually as a "propulsion module 25" or collectively as "propulsion modules 25**."

In various embodiments, a propulsion module 25 may be coupled to, or in communication with one or more electrodes E in magazine 12. In various embodiments, magazine 12 may comprise a plurality of propulsion modules 25, with each propulsion module 25 coupled to, or in communication with, one or more electrodes E. A propulsion module 25 may comprise any device, propellant (e.g., air, gas, etc.), primer, or the like capable of providing a propulsion force in magazine 12. The propulsion force may include an increase in pressure caused by rapidly expanding gas within an area or chamber. The propulsion force may be applied to one or more electrodes E in magazine 12 to cause the deployment of the one or more electrodes E. A propulsion module 25 may provide the propulsion force in response to magazine 12 receiving an ignition signal, as previously discussed.

In various embodiments, the propulsion force may be directly applied to one or more electrodes E. For example, a propulsion force from propulsion module 25-1 may be provided directly to first electrode E0. A propulsion module 25 may be in fluid communication with one or more electrodes E to provide the propulsion force. For example, a propulsion force from propulsion module 25-1 may travel within a housing or channel of magazine 12 to first electrode E0. The propulsion force may travel via a manifold in magazine 12.

In various embodiments, the propulsion force may be provided indirectly to one or more electrodes E. For example, the propulsion force may be provided to a secondary source of propellant within propulsion system 125. The propulsion force may launch the secondary source of propellant within propulsion system 125, causing the secondary source of propellant to release propellant. A force associated with the released propellant may in turn provide a force to one or more electrodes E. A force generated by a secondary source of propellant may cause the one or more electrodes E to be deployed from the magazine 12 and CEW 1.

In various embodiments, an electrode E may comprise any suitable type of projectile. For example, one or more electrodes E may be or include a projectile, a probe, an electrode (e.g., an electrode dart), an entangling projectile (e.g., a tether-based entangling projectile, a net, etc.), a payload projectile (e.g., comprising a liquid or gas substance), or the like. An electrode may include a spear portion, designed to pierce or attach proximate a tissue of a target in order to provide a conductive electrical path between the electrode and the tissue, as previously discussed herein.

In various embodiments, magazine 12 may be configured to receive one or more cartridges. For example, magazine 12 may define one or more bores. A bore may comprise an axial opening through magazine 12. Each bore may be configured to receive a cartridge. Each bore may be sized and shaped accordingly to receive and house the cartridge. Each bore may comprise any suitable deployment angle. One or more bores may comprise similar deployment angles. One or more bores may comprise different deployment angles. Magazine 12 may comprise any suitable or desired number of bores, such as, for example, two bores, five bores, nine bores, ten bores, and/or the like.

A cartridge may comprise a body (e.g., a cartridge body) housing an electrode E and one or more components necessary to deploy the electrode E from the body. For example, a cartridge may comprise an electrode E and a propulsion module. The propulsion module may be similar to any other propulsion module, primer, or the like disclosed herein.

In various embodiments, a cartridge may comprise a cylindrical outer body defining a hollow inner portion. The hollow inner portion may house an electrode E (e.g., an electrode E, a spear, filament wire, etc.). The hollow inner portion may house a propulsion module configured to deploy the electrode E from a first end of the cylindrical outer body. The cartridge may include a piston positioned adjacent a second end of the electrode E. The cartridge may have the propulsion module positioned such that the piston is located between the electrode E and the propulsion module. The cartridge may also have a wad positioned adjacent the piston, where the wad is located between the propulsion module and the piston.

In various embodiments, a cartridge may comprise a contact on an end of the body. The contact may be configured to allow the cartridge to receive an electrical signal from a CEW handle. For example, the contact may comprise an electrical contact configured to enable the completion of an electrical circuit between the cartridge and a signal generator of the CEW handle. In that regard, the contact may be configured to transmit (or provide) a stimulus signal from the CEW handle to the electrode E. As a further example, the contact may be configured to transmit (or provide) an electrical signal (e.g., an ignition signal) from the CEW handle to a propulsion module within the cartridge. For example, the contact may be configured to transmit (or provide) the electrical signal to a conductor of the propulsion module, thereby causing the conductor to heat up and ignite a pyrotechnic material inside the propulsion module. Ignition of the pyrotechnic material may cause the propulsion module to deploy (e.g., directly or indirectly) the electrode E from the cartridge.

In operation, a cartridge may be inserted into a bore of magazine 12. Magazine 12 may be inserted into the bay of a CEW handle. The CEW may be operated to deploy an electrode E from the cartridge in magazine 12. Magazine 12 may be removed from the bay of the CEW handle. The cartridge (e.g., a used cartridge, a spent cartridge, etc.) may be removed from the bore of magazine 12. A new cartridge may then be inserted into the same bore of magazine 12 for additional deployments. The number of cartridges that magazine 12 is capable of receiving may be dependent on a number of bores in magazine 12. For example, in response to magazine 12 comprising ten bores, magazine 12 may be configured to receive at most ten cartridges at the same time. As a further example, in response to magazine 12 comprising two bores, magazine 312 may be configured to receive at most two cartridges at the same time.

Control interface 17 of CEW 1 may comprise, or be similar to, any control interface disclosed herein. In various embodiments, control interface 17 may be configured to control selection of firing modes in CEW 1. Controlling selection of firing modes in CEW 1 may include disabling firing of CEW 1 (e.g., a safety mode, etc.), enabling firing of CEW 1 (e.g., an active mode, a firing mode, an escalation mode, etc.), controlling deployment of magazine 12, and/or similar operations, as discussed further herein. In various embodiments, control interface 17 may also be configured to perform (or cause performance of) one or more operations that do not include the selection of firing modes. For example, control interface 17 may be configured to enable the selection of operating modes of CEW 1, selection of options within an operating mode of CEW 1, or similar selection or scrolling operations, as discussed further herein.

Control interface 17 may be located in any suitable location on or in housing 10. For example, control interface 17 may be coupled to an outer surface of housing 10. Control interface 17 may be coupled to an outer surface of housing 10 proximate trigger 15 and/or a guard of housing 10. Control interface 17 may be electrically, mechanically, and/or electronically coupled to processing circuit 35. In various embodiments, in response to control interface 17 comprising electronic properties or components, control interface 17 may be electrically coupled to power supply 40. Control interface 17 may receive power (e.g., electrical current) from power supply 40 to power the electronic properties or components.

Control interface 17 may be electronically or mechanically coupled to trigger 15. For example, and as discussed further herein, control interface 17 may function as a safety mechanism. In response to control interface 17 being set to a "safety mode," CEW 1 may be unable to launch electrodes from magazine 12. For example, control interface 17 may provide a signal (e.g., a control signal) to processing circuit 35 instructing processing circuit 35 to disable deployment of electrodes from magazine 12. As a further example, control interface 17 may electronically or mechanically prohibit trigger 15 from activating (e.g., prevent or disable a user from depressing trigger 15; prevent trigger 15 from launching an electrode; etc.).

Control interface 17 may comprise any suitable electronic or mechanical component capable of enabling selection of firing modes. For example, control interface 17 may comprise a fire mode selector switch, a safety switch, a safety catch, a rotating switch, a selection switch, a selective firing mechanism, and/or any other suitable mechanical control. As a further example, control interface 17 may comprise a slide, such as a handgun slide, a reciprocating slide, or the like. As a further example, control interface 17 may comprise a touch screen, user interface or display, or similar electronic visual component.

The safety mode may be configured to prohibit deployment of an electrode from magazine 12 in CEW 1. For example, in response to a user selecting the safety mode, control interface 17 may transmit a safety mode instruction to processing circuit 35. In response to receiving the safety mode instruction, processing circuit 35 may prohibit deployment of an electrode from magazine 12. Processing circuit 35 may prohibit deployment until a further instruction is received from control interface 17 (e.g., a firing mode instruction). As previously discussed, control interface 17 may also, or alternatively, interact with trigger 15 to prevent activation of trigger 15. In various embodiments, the safety mode may also be configured to prohibit deployment of a stimulus signal from signal generator 45, such as, for example, a local delivery.

The firing mode may be configured to enable deployment of one or more electrodes from magazine 12 in CEW 1. For example, and in accordance with various embodiments, in response to a user selecting the firing mode, control interface 17 may transmit a firing mode instruction to processing circuit 35. In response to receiving the firing mode instruction, processing circuit 35 may enable deployment of an electrode from magazine 12. In that regard, in response to trigger 15 being activated, processing circuit 35 may cause the deployment of one or more electrodes. Processing circuit 35 may enable deployment until a further instruction is received from control interface 17 (e.g., a safety mode instruction). As a further example, and in accordance with various embodiments, in response to a user selecting the firing mode, control interface 17 may also mechanically (or electronically) interact with trigger 15 of CEW 1 to enable activation of trigger 15.

In various embodiments, CEW 1 may deliver a stimulus signal via a circuit that includes signal generator 45 positioned in the handle of CEW 1. An interface (e.g., cartridge interface, magazine interface, etc.) on each magazine 12 inserted into housing 10 electrically couples to an interface (e.g., handle interface, housing interface, etc.) in handle housing 10. Signal generator 45 couples to each magazine 12, and thus to the electrodes E, via the handle interface and the magazine interface. A first filament couples to the interface of the magazine 12 and to a first electrode. A second filament couples to the interface of the magazine 12 and to a second electrode. The stimulus signal travels from signal generator 45, through the first filament and the first electrode, through target tissue, and through the second electrode and second filament back to signal generator 45.

In various embodiments, CEW 1 may further comprise one or more user interfaces 37. A user interface 37 may be configured to receive an input from a user of CEW 1 and/or transmit an output to the user of CEW 1. User interface 37 may be located in any suitable location on or in housing 10. For example, user interface 37 may be coupled to an outer surface of housing 10, or extend at least partially through the outer surface of housing 10. User interface 37 may be electrically, mechanically, and/or electronically coupled to processing circuit 35. In various embodiments, in response to user interface 37 comprising electronic or electrical properties or components, user interface 37 may be electrically coupled to power supply 40. User interface 37 may receive power (e.g., electrical current) from power supply 40 to power the electronic properties or components.

In various embodiments, user interface 37 may comprise one or more components configured to receive an input from a user. For example, user interface 37 may comprise one or more of an audio capturing module (e.g., microphone) configured to receive an audio input, a visual display (e.g., touchscreen, LCD, LED, etc.) configured to receive a manual input, a mechanical interface (e.g., button, switch, etc.) configured to receive a manual input, and/or the like. In various embodiments, user interface 37 may comprise one or more components configured to transmit or produce an output. For example, user interface 37 may comprise one or more of an audio output module (e.g., audio speaker) configured to output audio, a light-emitting component (e.g., flashlight, laser guide, etc.) configured to output light, a visual display (e.g., touchscreen, LCD, LED, etc.) configured to output a visual, and/or the like.

Figure 3A:
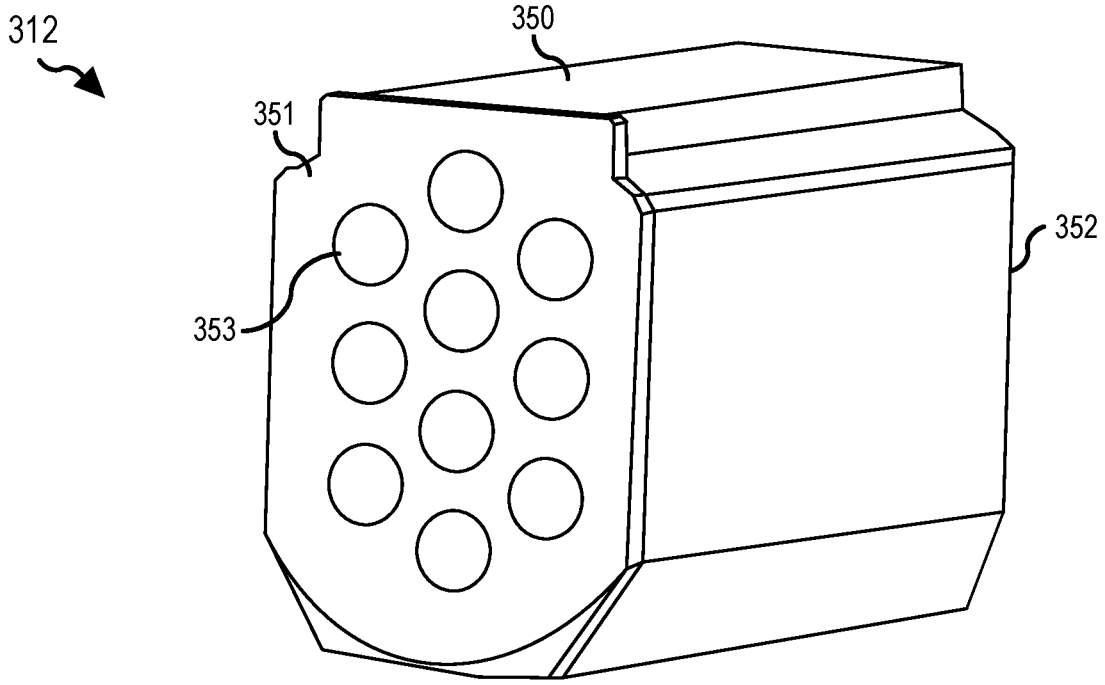
FIG. 3A is a front perspective view of a magazine for a CEW, in accordance with various embodiments.
Figure 3B:
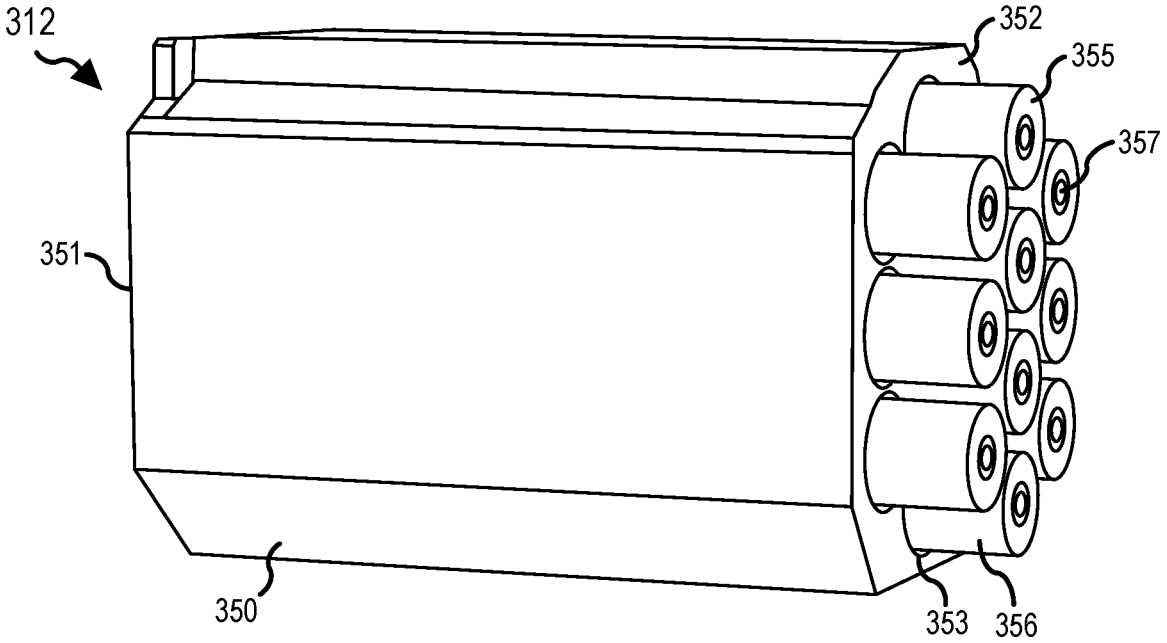
FIG. 3B is a rear perspective view of a magazine for a CEW, in accordance with various embodiments.

In various embodiments, and with reference to FIGS. 3A and 3B, a magazine 312 for a CEW is disclosed. Magazine 312 may be similar to any other magazine or the like disclosed herein.

Magazine 312 may comprise a housing 350 sized and shaped to be inserted into the bay of a CEW handle, as previously discussed. Housing 350 may comprise a first end 351 (e.g., a deployment end, a front end, etc.) opposite a second end 352 (e.g., a loading end, a rear end, etc.). Magazine 312 may be configured to permit launch of one or more electrodes from first end 351 (e.g., electrodes are launched through first end 351). Magazine 312 may be configured to permit loading of one or more electrodes from second end 351. Second end 351 may also be configured to permit provision of stimulus signals from the CEW to the one or more electrodes. In some embodiments, magazine 312 may also be configured to permit loading of one or more electrodes from first end 351.

In various embodiments, housing 350 may define one or more bores 353. A bore 353 may comprise an axial opening through housing 350, defined and open on first end 351 and/or second end 352. Each bore 353 may be configured to receive an electrode (or cartridge containing an electrode). Each bore 353 may be sized and shaped accordingly to receive and house an electrode (or cartridge containing an electrode) prior to and during deployment of the electrode from magazine 312. Each bore 353 may comprise any suitable deployment angle. One or more bores 353 may comprise similar deployment angles. One or more bores 353 may comprise different deployment angles. Housing 350 may comprise any suitable or desired number of bores 353, such as, for example, two bores, five bores, nine bores, ten bores (e.g., as depicted), and/or the like.

In various embodiments, magazine 312 may be configured to receive one or more cartridges 355. A cartridge 355 may comprise a body 356 housing an electrode and one or more components necessary to deploy the electrode from body 356. For example, cartridge 355 may comprise an electrode and a propulsion module. The electrode may be similar to any other electrode, projectile, or the like disclosed herein. The propulsion module may be similar to any other propulsion module, primer, or the like disclosed herein.

In various embodiments, cartridge 355 may comprise a cylindrical outer body 356 defining a hollow inner portion. The hollow inner portion may house an electrode (e.g., an electrode, a spear, filament wire, etc.), or any other projectile disclosed herein. The hollow inner portion may house a propulsion module configured to deploy the electrode from a first end of the cylindrical outer body 356. Cartridge 355 may include a piston positioned adjacent a second end of the electrode. Cartridge 355 may have the propulsion module positioned such that the piston is located between the electrode and the propulsion module. Cartridge 355 may also have a wad positioned adjacent the piston, where the wad is located between the propulsion module and the piston.

In various embodiments, a cartridge 355 may comprise a contact 357 on an end of body 356. Contact 357 may be configured to allow cartridge 355 to receive an electrical signal from a CEW handle. For example, contact 357 may comprise an electrical contact configured to enable the completion of an electrical circuit between cartridge 355 and a signal generator of the CEW handle. In that regard, contact 357 may be configured to transmit (or provide) a stimulus signal from the CEW handle to the electrode. As a further example, contact 357 may be configured to transmit (or provide) an electrical signal (e.g., an ignition signal) from the CEW handle to a propulsion module within the cartridge 355. For example, contact 357 may be configured to transmit (or provide) the electrical signal to a conductor of the propulsion module, thereby causing the conductor to heat up and ignite a pyrotechnic material inside the propulsion module. Ignition of the pyrotechnic material may cause the propulsion module to deploy (e.g., directly or indirectly) the electrode from the cartridge 355.

In operation, a cartridge 355 may be inserted into a bore 353 of a magazine 312. The magazine 312 may be inserted into the bay of a CEW handle. The CEW may be operated to deploy an electrode from the cartridge 355 in magazine 312. Magazine 312 may be removed from the bay of the CEW handle. The cartridge 355 (e.g., a used cartridge, a spent cartridge, etc.) may be removed from the bore 353 of magazine 312. A new cartridge 355 may then be inserted into the same bore 353 of magazine 312 for additional deployments. The number of cartridges 355 that magazine 312 is capable of receiving may be dependent on a number of bores 353 in housing 350. For example, in response to housing 350 comprising ten bores 353, magazine 312 may be configured to receive at most ten cartridges 355 at the same time. As a further example, in response to housing 350 comprising two bores 353, magazine 312 may be configured to receive at most two cartridges 355 at the same time.

In various embodiments, a cartridge may comprise a plurality of grooves on an inner surface of the cartridge. The grooves may be defined on the inner surface of the cartridge from an end of the cartridge (e.g., a deployment end) to a location within the cartridge. The grooves may comprise an arrangement of separated helical grooves. In various embodiments, each groove may define recesses radially inward from the inner surface of the cartridge. In various embodiments, each groove may be defined by a plurality of ridges extending radially outward from the inner surface of the cartridge (e.g., the grooves are recessed in comparison to the plurality of ridges).

In some embodiments, a cartridge may comprise a plurality of grooves on an inner surface of the cartridge configured to impart a rotation (e.g., spin) on a projectile during deployment of the projectile from the cartridge. The plurality of grooves may be arranged, sized, and shaped to impart the rotation. The projectile may contact the plurality of grooves during deployment to cause the projectile to rotate.

The plurality of grooves may be configured to impart the rotation around a longitudinal axis of the projectile. The projectile may continue to rotate after being deployed from the cartridge (e.g., while in flight, while no longer in contact with the plurality of grooves, etc.).

In some embodiments, a cartridge may comprise a plurality of grooves on an inner surface of the cartridge configured to improve the accuracy of deployment of a projectile deployed from the cartridge.

In some embodiments, a cartridge may comprise a plurality of grooves on an inner surface of the cartridge configured to stabilize a projectile during deployment of the projectile from the cartridge. For example, the plurality of grooves may stabilize the projectile longitudinally by conservation of angular momentum, thereby improving aerodynamic stability and accuracy during flight of the projectile.

In some embodiments, a cartridge may comprise a plurality of grooves on an inner surface of the cartridge configured to contact a projectile and cause gyroscopic forces on the projectile during deployment of the projectile from the cartridge. The gyroscopic forces may cause the projectile to spin during flight of the projectile.

In some embodiments, a cartridge may comprise a plurality of grooves on an inner surface of the cartridge configured to contact a projectile during deployment of the projectile from the cartridge. The projectile may be deployed from the cartridge using a propulsive gas. The plurality of grooves may be sized and shaped to contact the projectile to at least partially decrease a loss of gas radially and/or axially outward the projectile during deployment of the projectile. At least partially decreasing the loss of gas may increase efficiency of deployment of the projectile. At least partially decreasing the loss of gas may increase velocity of deployment of the projectile from the cartridge.

In some embodiments, a cartridge may comprise a projectile configured to be deployed from the cartridge using a piston. The cartridge may comprise a plurality of grooves on an inner surface of the cartridge configured to contact and stop the piston during deployment of the projectile from the cartridge. In that regard, the plurality of grooves may function as a piston stop within the cartridge.

Figure 4A:
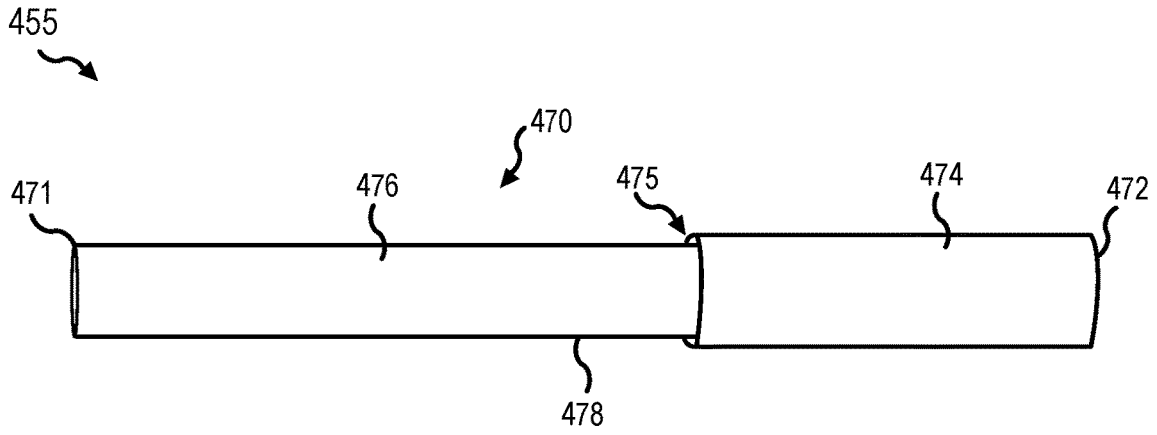
FIG. 4A is a perspective view of a cartridge, in accordance with various embodiments.
Figure 4B:
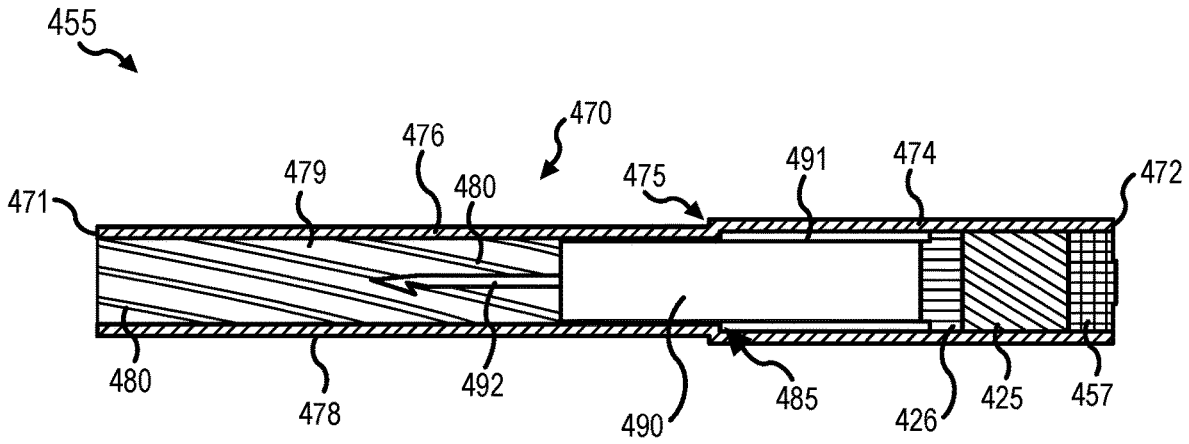
FIG. 4B is a cross-sectional view of a cartridge, in accordance with various embodiments.

In various embodiments, and with reference to FIGS. 4A and 4B, a cartridge 455 is disclosed. Cartridge 455 may be similar to any other cartridge disclosed herein. Cartridge 455 may comprise a body 470 having a first end 471 (e.g., a deployment end) opposite a second end 472 (e.g., a contact end). Body 470 may comprise a cylindrical shape. Body 470 may comprise a monolithic structure, or may comprise separate structures coupled to form a singular body.

Body 470 may be sized and shaped to be received into a magazine. For example, body 470 may be configured to be removably inserted into an opening of a housing of the magazine. The opening of the housing may comprise a greater diameter than the body. The opening of the housing may comprise a smooth surface relative to the inner surface of body 470. The housing of the magazine may be configured to be received by a handle of a CEW, as discussed further herein.

In response to a deployment of a projectile from cartridge 455, the projectile may exit through a first end of body 470 and out the opening of the housing. In various embodiments, during deployment the projectile may travel substantially through body 470 and may only pass through a portion, if any, of the opening. For example, during deployment the projectile may travel from a starting position to a position external a front surface of the magazine. A distance between the starting position and the position external the front surface of the magazine may be substantially defined by body 470.

In various embodiments, body 470 may comprise a wide portion 474 (e.g., a base) and an elongated portion 476 (e.g., a firing tube, bore, etc.). Wide portion 474 may define second end 472. Elongated portion 476 may define first end 471. Body 470 may define a step 475 between (and separating) wide portion 474 and elongated portion 476. Step 475 may define an outer surface of body 470 extending radially inward relative to wide portion 474. Step 475 may define an outer surface of body 470 extending radially outward relative to elongated body 476. In that regard, wide portion 474 may define a portion of body 470 from second end 452 to step 475 and elongated portion 476 may define a portion of body 470 from first end 451 to step 475.

Wide portion 474 and elongated portion 476 may comprise different dimensions. For example, wide portion 474 may comprise a first width (e.g., a first cartridge width) and a first length (e.g., a first cartridge length). Elongated portion 476 may comprise a second width (e.g., a second cartridge width) and a second length (e.g., a second cartridge length). The first width may be greater than the second width (e.g., the second width may be less than the first width). The first length may be less than the second length (e.g., the second length may be greater than the first length).

Body 470 may comprise an outer surface 478 opposite an inner surface 479. Outer surface 478 may be configured to contact a bore of a magazine in response to being inserted into the magazine. Inner surface 479 may define an opening (e.g., a bore, a barrel, etc.) through body 470 configured to retain a projectile and one or more components configured to cause deployment of the projectile.

In various embodiments, inner surface 479 of body 470 may define a piston stop 485 between (and separating) wide portion 474 and elongated portion 476. Piston stop 485 may define an inner surface of body 470 extending radially inward relative to wide portion 474. Piston stop 485 may define an inner surface of body 470 extending radially outward relative to elongated body 476. Piston stop 485 may define an inner surface portion of body 470 opposite step 475.

In various embodiments, body 470 may comprise a contact 457 on second end 472. Contact 457 may be similar to any other contact disclosed herein. Contact 457 may be configured to allow cartridge 455 to receive an electrical signal from a CEW handle. For example, contact 457 may comprise an electrical contact configured to enable the completion of an electrical circuit between cartridge 455 and a signal generator of the CEW handle. In that regard, contact 457 may be configured to transmit (or provide) a stimulus signal from the CEW handle to the electrode. As a further example, contact 457 may be configured to transmit (or provide) an electrical signal (e.g., an ignition signal) from the CEW handle to a propulsion module within cartridge 455. For example, contact 457 may be configured to transmit (or provide) the electrical signal to a conductor of the propulsion module, thereby causing the conductor to heat up and ignite a pyrotechnic material inside the propulsion module. Ignition of the pyrotechnic material may cause the propulsion module to deploy (e.g., directly or indirectly) the electrode from the cartridge 455.

In various embodiments, cartridge 455 may comprise a propulsion module 425 disposed within body 470. Propulsion module 425 may be similar to any other propulsion module disclosed herein. Propulsion module 425 may be configured to provide a propulsive force to cause deployment of a projectile from cartridge 455.

In various embodiments, propulsion module 425 may comprise any type of device that may be controlled to provide a rapidly expanding gas. Propulsion module 425 may be ignited to launch a projectile from cartridge 455. For example, propulsion module 425 may comprise a primer. The primer may be ignited in any manner, such as by a striking (e.g., percussion) movement that directly or indirectly contacts the primer or electrically by passing a current through the primer. When electrically ignited, the electrical current by a direct current or an alternating current. In some embodiments, the electrical current for igniting a primer may be a pulsed current or a current provided as a step function. The polarity of the current may be positive or negative.

For example, in some embodiments, the primer may be ignited via a mechanical striking force. For example, a mechanical striking force may be applied to contact 457. The striking force may be transferred by contact 457 to propulsion module 425. The striking force may pierce (e.g., penetrate) and/or crush (e.g., compress) the primer in propulsion module 425 thereby causing (e.g., initiating) a chemical reaction in the primer that causes the pyrotechnic material of the primer to burn (e.g., ignite). The burning of the primer produces a rapidly expanding gas. The striking force may be provided by any object such as, for example, a firing pin.

In other embodiments, propulsion module 425 may be ignited via an electrical current. For example, a current may be provided to contact 457. Contact 457 may include electrical paths (e.g., conductors) that permit the current to flow through contact 457 to propulsion module 425. Contact 457 may include mechanical structures that include electrical paths to the primer in propulsion module 425. Flow of a current to the primer may cause a conductor to heat up thereby igniting the pyrotechnic material inside the primer. An electrical path for the current may include contact 457, propulsion module 425, and/or body 470. For example, body 470 may be grounded and a voltage having a positive or negative polarity may be applied to contact 457 to induce a current to flow through contact 457 to propulsion module 425. Igniting the pyrotechnic material in the primer of propulsion module 425 produces a rapidly expanding gas.

The force from the rapidly expanding gas directed against contact 457 is redirected forward in body 470. The force is applied forward against piston 426, and piston 426 applies a force on a rear-end portion of an electrode 490. The force from the rapidly expanding gas moves piston 426 and electrode 490 in a forward direction. As electrode 490 moves in a forward direction, piston 426 contacts piston stop 485 causing piston 426 to cease moving forward. Forward movement of electrode 490 does not cease when piston 426 contacts piston stop 485. Electrode 490 continues to move in a forward direction to exit body 470 to fly toward a target and provide a stimulus signal through the target.

In various embodiments, cartridge 455 may also comprise a wad. The wad may be positioned between propulsion module 425 and piston 426. During launch of electrode 490, the force from the rapidly expanding gas of propulsion module 425 may be applied first against the wad. The wad may apply a force on piston 426, and piston 426 may apply a force on a rear-end portion of electrode 490. The wad may be configured to at least partially reduce an amount of the rapidly expanding gas that bypasses the wad to exit body 470 with electrode 490. The wad may retain the rapidly expanding gas so that the gas does not pass, at least initially, forward of the wad. By retaining the expanding gas, the force applied to the wad, piston 426, and electrode 490 may be increased. Any gas that bypasses the wad may reduce the amount of force that is applied to electrode 490.

In various embodiments, electrode 490 may comprise any electrode, projectile, or the like disclosed herein. For example, although depicted an electrode for a CEW, electrode 490 may alternatively comprise a projectile such as a lethal payload, a less-lethal payload, a non-lethal payload a rubber bullet, a standard electrode, an article penetrating electrode, an entangling projectile (e.g., a tether-based entangling projectile, a net, etc.), a scent-based projectile, a pepper spray projectile (e.g., oleoresin capsicum, OC spray), a tear gas projectile (e.g., 2-chlorobenzalmalononitrile, CS spray), and/or the like.

In various embodiments, electrode 490 may comprise a body 490 (e.g., an electrode body). Electrode 490 may comprise a spear 492 coupled to a forward-end of electrode 490. Electrode 490 may be disposed within body 470 (e.g., cartridge body) and configured to deploy from first end 471.

In various embodiments, electrode 490 may comprise a wire-tether configured to mechanically and/or electrically couple electrode 490 to cartridge 455 before, during, and/or after deployment of electrode 490. For example, electrode 490 may be in electrical series with the wire-tether, body 470 (or contact 457), a magazine the cartridge is loaded in, and/or a signal generator of a CEW handle.

In various embodiments, cartridge 455 may comprise a plurality of grooves 480 defined on inner surface 479 of body 470. Grooves 480 may be similar to any other inner surface cartridge body grooves disclosed herein. Each groove 480 may comprise any suitable size and/or shape. Each groove 480 may be substantially similar in size and shape. Each groove 480 may comprise a helical shape and/or any other shape.

Cartridge 455 may comprise any suitable or desired number of grooves 480. Grooves 480 may each be separated by a distance. In various embodiments, each groove 480 may be equidistantly separated (e.g., a first groove is equidistant from a second groove). Grooves 480 may comprise an arrangement of about equidistantly separated helical grooves (wherein "about" as used in this context refers only to +/−0.01 inches (0.254 centimeters)).

In various embodiments, each groove 480 may be defined as a relief radially inward from inner surface 479 of body 470 (e.g., grooves 480 are recessed in comparison to inner surface 479). In various embodiments, each groove 480 may be defined by a plurality of ridges extending radially outward from inner surface 479 of body 470 (e.g., grooves 480 are recessed in comparison to the plurality of ridges).

In various embodiments, grooves 480 may be defined on inner surface 479 from first end 471 to a location within body 470. Grooves 480 may extend from first end 471 to the location within body 470. The location may comprise any suitable or desired location within body 470. For example, the location may be proximate electrode 490 (e.g., prior to electrode 490 being deployed from cartridge 455). The location may be proximate piston stop 485. The location may be proximate a front surface of electrode 490. The location may be proximate a rear surface of electrode 490. The location may be between a front surface of electrode 490 and a rear surface of electrode 490. In some embodiments, the location may be proximate a midpoint of body 491 of electrode 490. In some embodiments, the location may be proximate second end 472.

Each groove 480 may extend continuously from first end 471 to the location within body 470. Each groove 480 may extend a length of elongated portion 476. The length may be defined by first end 471 and the location.

In various embodiments, a portion of inner surface 479 from the location to second end 472 may comprise a smooth surface relative to a portion of inner surface 479 defining the grooves.

In various embodiments, grooves 480 may be defined in any suitable direction. For example, grooves 480 may be defined in an at least partial axial direction. Grooves 480 may be defined in an at least partial circumferential direction. Grooves 480 may be defined in an at least partial axial and circumferential direction.

In various embodiments, electrode 490 may be configured to at least partially contact grooves 480 while disposed within body 470. In various embodiments, electrode 490 may be configured to at least partially contact grooves 480 during a deployment of electrode 490 from cartridge 455. In various embodiments, electrode 490 may be configured to at least partially contact grooves 480 both before and during a deployment of electrode 490.

In various embodiments, at least a portion of electrode 490 may be configured to contact grooves 480. For example, a front surface of electrode 490 may be configured to contact grooves 480. As a further example, body 491 of electrode 490 may be configured to at least partially contact grooves 480.

Figure 5A:
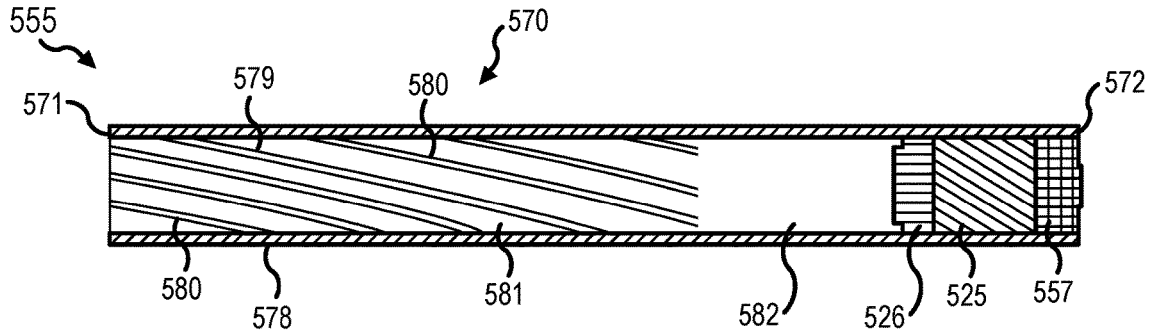
FIG. 5A is a cross-sectional view of a cartridge without a projectile, in accordance with various embodiments.
Figure 5B:
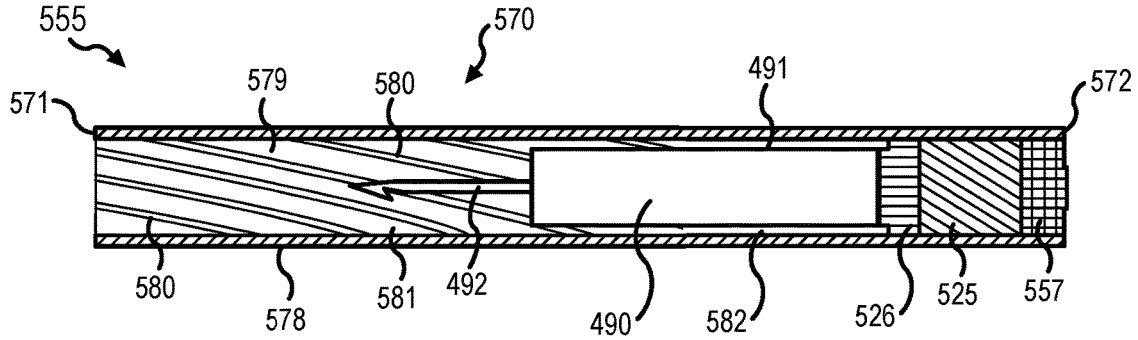
FIG. 5B is a cross-sectional view of a cartridge with a projectile, in accordance with various embodiments.
Figure 5C:
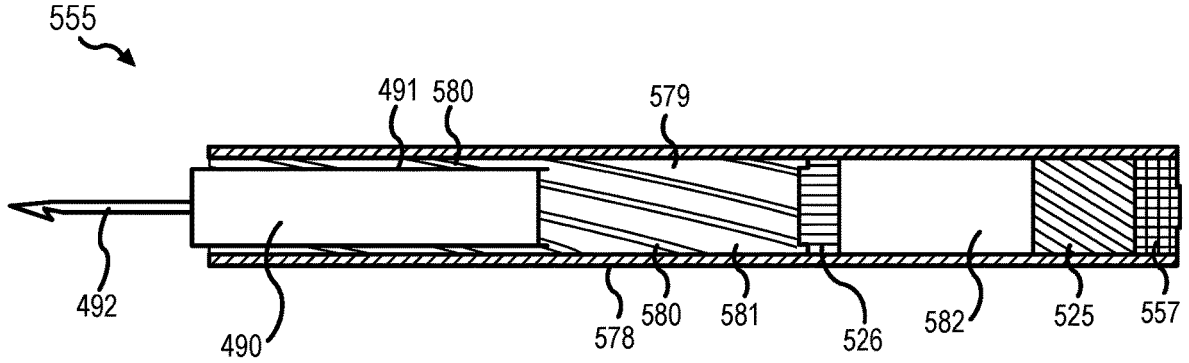
FIG. 5C is a cross-sectional view of a cartridge with a deployed projectile, in accordance with various embodiments.

In various embodiments, and with reference to FIGS. 5A-5C, a cartridge 555 is disclosed. FIG. 5A depicts cartridge 555 without an electrode 490 for ease of illustration. FIGS. 5B and 5C depict cartridge 555 with an electrode 490 during various stages of deployment of electrode 490. For example, FIG. 5B depicts cartridge 555 before a deployment and FIG. 5C depicts cartridge 555 responsive to a deployment (e.g., after or during a deployment). Cartridge 555 may be similar to any other cartridge disclosed herein.

Cartridge 555 may comprise a body 570 having a first end 571 (e.g., a deployment end) opposite a second end 572 (e.g., a contact end). Body 570 may comprise a cylindrical shape. Body 570 may comprise a monolithic structure, or may comprise separate structures coupled to form a singular body.

Body 570 may be sized and shaped to be received into a magazine. For example, body 570 may be configured to be removably inserted into an opening of a housing of the magazine. The opening of the housing may comprise a greater diameter than the body. The opening of the housing may comprise a smooth surface relative to the inner surface of body 570. The housing of the magazine may be configured to be received by a handle of a CEW, as discussed further herein.

Body 570 may comprise an outer surface 578 opposite an inner surface 579. Outer surface 578 may be configured to contact a bore of a magazine in response to being inserted into the magazine. Inner surface 579 may define an opening (e.g., a bore, a barrel, etc.) through body 570 configured to retain a projectile and one or more components configured to cause deployment of the projectile.

In various embodiments, body 570 may comprise a contact 557 on second end 572. Contact 557 may be similar to any other contact disclosed herein.

In various embodiments, cartridge 555 may comprise a propulsion module 525 disposed within body 570. Propulsion module 525 may be similar to any other propulsion module disclosed herein. Propulsion module 525 may be configured to provide a propulsive force to cause deployment of a projectile from cartridge 555.

In various embodiments, cartridge 555 may comprise a piston 526. Piston 526 may be similar to any other piston disclosed herein. The propulsive force from propulsion module 525 may be applied forward against piston 526, and piston 526 applies a force on a rear-end portion of an electrode 590. In various embodiments, cartridge 555 may also comprise a wad. The wad may be similar to any other wad disclosed herein.

In various embodiments, cartridge 555 may comprise a plurality of grooves 580 defined on inner surface 579 of body 570. Grooves 580 may be similar to any other inner surface cartridge body grooves disclosed herein. Each groove 580 may comprise any suitable size and/or shape. Each groove 580 may be substantially similar in size and shape. Each groove 580 may comprise a helical shape and/or any other shape.

Cartridge 555 may comprise any suitable or desired number of grooves 580. Grooves 580 may each be separated by a distance. In various embodiments, each groove 580 may be equidistantly separated (e.g., a first groove is equidistant from a second groove). Grooves 580 may comprise an arrangement of about equidistantly separated helical grooves (wherein "about" as used in this context refers only to +/−0.01 inches (0.254 centimeters)).

In various embodiments, each groove 580 may be defined by a plurality of ridges 581 (e.g., landings, radial protrusions, platforms, etc.) extending radially outward from inner surface 579 of body 570 (e.g., grooves 580 are recessed in comparison to the plurality of ridges 581). For example, each ridge 581 may protrude radially outward from inner surface 579 towards a radial centerpoint of body 570 (e.g., a longitudinal axis of body 570). In that regard, each ridge 581 may be radially inward from each groove 580, relative to the radial centerpoint of body 570. Each ridge 581 may be radially outward from each groove 580, relative to inner surface 579.

In various embodiments, grooves 580 may be defined on inner surface 579 from first end 571 to a location within body 570. Grooves 580 may extend from first end 571 to the location within body 570. The location may comprise any suitable or desired location within body 570. For example, the location may be proximate electrode 490 (e.g., prior to electrode 490 being deployed from cartridge 555). The location may be proximate a front surface of electrode 490. The location may be proximate a rear surface of electrode 490. The location may be between a front surface of electrode 490 and a rear surface of electrode 490. In some embodiments, the location may be proximate a midpoint of body 491 of electrode 490. In some embodiments, the location may be proximate second end 572.

Each groove 580 may extend continuously from first end 571 to the location within body 570. Each groove 580 may extend a length of elongated portion 576. The length may be defined by first end 571 and the location.

In various embodiments, a portion of inner surface 579 from the location to second end 572 may comprise a smooth surface 582 relative to a portion of inner surface 579 defining the grooves 580 and ridges 581. Smooth surface 582 and grooves 580 may be substantially equidistant from a radial centerpoint of body 570. For example, smooth surface 582 and grooves 580 may comprise a continuous surface wherein grooves 580 are defined by ridges 581. Each ridge 581 may be radially inward from each groove 580 and smooth surface 582, relative to the radial centerpoint of body 570. Each ridge 581 may be radially outward from each groove 580 and smooth surface 582, relative to inner surface 579.

In various embodiments, grooves 580 may be defined in any suitable direction. For example, grooves 580 may be defined in an at least partial axial direction. Grooves 580 may be defined in an at least partial circumferential direction. Grooves 580 may be defined in an at least partial axial and circumferential direction.

In various embodiments, electrode 490 may be configured to at least partially contact grooves 580 and/or ridges 581 while disposed within body 570. In various embodiments, electrode 490 may be configured to at least partially contact grooves 580 and/or ridges 581 during a deployment of electrode 490 from cartridge 555. In various embodiments, electrode 490 may be configured to at least partially contact grooves 580 and/or ridges 581 both before and during a deployment of electrode 590.

In various embodiments, at least a portion of electrode 490 may be configured to contact grooves 580 and/or ridges 581. For example, a front surface of electrode 490 may be configured to contact grooves 580 and/or ridges 581. As a further example, body 491 of electrode 490 may be configured to at least partially contact grooves 580 and/or ridges 581.

In various embodiments, piston 526 may be configured to at least partially contact ridges 581 in response to a deployment of electrode 490. In that regard, ridges 581 at the location between grooves 580 and ridges 581 and smooth surface 582 may function as a piston stop.

For example, piston 526 may be sized and shaped to contact ridges 581 during deployment of electrode 490. Ridges 581 may be sized and shaped to at least partially prevent (e.g., cease) forward movement of piston 526 during deployment of electrode 490. Ridges 581 may be configured to contact piston 526 on a forward surface of piston 526. Ridges 581 may be configured to contact piston 526 on an outer edge of piston 526, proximate a forward surface of piston 526.

For example, during deployment of electrode 490 a propulsive force from propulsion module 525 may be applied forward against piston 526, and piston 526 may apply a force on a rear-end portion of an electrode 490 (e.g., as depicted in FIG. 5B). The propulsive force may move piston 526 and electrode 490 in a forward direction towards first end 571. As electrode 490 moves in a forward direction, piston 526 contacts ridges 581 causing piston 426 to cease moving forward (e.g., as depicted in FIG. 5C). Forward movement of electrode 490 does not cease when piston 526 contacts ridges 581. Electrode 490 continues to move in a forward direction to exit body 570 to fly toward a target and provide a stimulus signal through the target.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosures. The scope of the disclosure is accordingly to be limited by nothing other than the appended claims and their legal equivalents, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B, and C may be present in a single embodiment; for example, A and B, A and C, B and C, or A and B and C.

Systems, methods, and apparatus are provided herein. In the detailed description herein, references to "various embodiments," "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments. Furthermore, no element, component, or method step in the present disclosure is intended to be dedicated to the public regardless of whether the element, component, or method step is explicitly recited in the claims. No claim element is intended to invoke 35 U.S.C. 112(f) unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A cartridge for a conducted electrical weapon, comprising:

a body comprising a first end opposite a second end, and an outer surface opposite an inner surface, wherein the inner surface defines a plurality of grooves extending from the first end to a location within the body, and wherein the inner surface defines a smooth surface from the second end to the location; and a projectile disposed within the body and configured to be deployed from the first end of the body, wherein prior to a deployment of the projectile a front surface of the projectile is surrounded by the plurality of grooves and a rear surface of the projectile is surrounded by the smooth surface.

2. The cartridge of claim 1, wherein the body further comprises a wide portion and an elongated portion, wherein the elongated portion is defined from the first end to the location, wherein the wide portion is defined from the second end to the location, wherein the wide portion comprises a greater outer diameter than the elongated portion, and wherein the body defines a step between the wide portion and the elongated portion.

3. The cartridge of claim 2, wherein the step defines a piston stop on the inner surface of the body, and wherein the location is proximate the piston stop.

4. The cartridge of claim 3, further comprising a piston disposed within the second end of the body, wherein the piston is in contact with the smooth surface, and wherein the piston is configured to cause the deployment of the projectile.

5. The cartridge of claim 4, wherein during the deployment the piston is configured to contact the piston stop to cease forward movement of the piston within the body.

6. The cartridge of claim 4, wherein the piston is configured to contact the smooth surface before, during, and after the deployment.

7. The cartridge of claim 4, wherein an outer diameter of the piston is greater than an inner diameter of the elongated portion.

8. The cartridge of claim 1, wherein the location is between the front surface of the projectile and the rear surface of the projectile.

9. The cartridge of claim 1, wherein each groove of the plurality of grooves comprises a helical shape.

10. The cartridge of claim 1, wherein each groove of the plurality of grooves is continuous from the first end of the body to the location.

11. The cartridge of claim 1, wherein the projectile contacts the plurality of grooves before and during the deployment of the projectile from the body.

12. The cartridge of claim 1, wherein prior to the deployment the front surface of the projectile is separated from the inner surface by a first distance and the rear surface of the projectile is separated from the inner surface by a second distance, and wherein the second distance is greater than the first distance.

13. A magazine for a conducted electrical weapon, comprising:

a housing;

an opening defined through the housing; and a cartridge disposed within the opening of the housing, the cartridge comprising:

a body comprising a first end opposite a second end, wherein the body defines a bore through the first end, wherein the bore defines an outer surface opposite an inner surface, wherein the inner surface defines a plurality of grooves from the first end to a location within the body, and wherein the inner surface defines a smooth surface from the second end to the location; and a projectile disposed within the bore and configured to be deployed from the first end of the body, wherein prior to a deployment of the projectile a front surface of the projectile is surrounded by the plurality of grooves and a rear surface of the projectile is surrounded by the smooth surface.

14. The magazine of claim 13, wherein the opening of the housing comprises a second smooth surface relative to the inner surface of the bore from the first end to the location.

15. The magazine of claim 13, wherein the opening of the housing comprises a greater diameter than the bore of the body.

16. The magazine of claim 13, wherein the location within the bore is between the front surface and the rear surface of the projectile.

17. A cartridge, comprising:

a body comprising a first end opposite a second end, and an outer surface opposite an inner surface, wherein the inner surface defines a plurality of grooves from the first end to a location within the body, wherein each groove of the plurality of grooves is defined by a plurality of ridges extending radially outward from the inner surface, and wherein the inner surface defines a smooth surface from the second end to the location;

a projectile disposed within the body proximate the location; and a piston positioned within the body against the smooth surface and between the second end of the body and the projectile, wherein the piston is configured to cause a deployment of the projectile from the first end of the body, wherein in response to the deployment of the projectile, the piston is configured to contact the plurality of ridges at the location, and wherein contact with the plurality of ridges at the location causes the piston to cease forward movement within the body.

18. The cartridge of claim 17, wherein the plurality of ridges are defined continuously from the first end of the body to the location within the body.

19. The cartridge of claim 17, wherein the location within the body is between a front surface of the projectile and a rear surface of the projectile.

20. The cartridge of claim 17, wherein during the deployment an axially forward surface of the piston is configured to contact the plurality of ridges at the location while a radially outer surface of the piston remains positioned against the smooth surface.

* * * * *